US006010126A

United States Patent [19]

Mou et al.

[11] Patent Number: 6,010,126

[45] Date of Patent: Jan. 4, 2000

[54] SHEET-BY-SHEET PAPER FEEDING STRUCTURE

[75] Inventors: Michael Mou, Tu-Cheng; Chin-Lung Huang, Taipei, both of Taiwan

[73] Assignee: Dbtel Incorporated, Taipei Hsien, Taiwan

[21] Appl. No.: 09/064,730

[22] Filed: Apr. 23, 1998

[51] Int. Cl.[7] ..... B65H 3/52

[52] U.S. Cl. ..... 271/121

[58] Field of Search ..... 271/121, 124

[56] References Cited

U.S. PATENT DOCUMENTS

| | | | |
|---|---|---|---|
| 4,887,806 | 12/1989 | Tanaka et al. | 271/121 |
| 5,277,416 | 1/1994 | Kim | 271/121 |
| 5,549,289 | 8/1996 | Sonnenburg et al. | 271/121 |
| 5,718,424 | 2/1998 | Nakatani et al. | 271/121 |
| 5,764,384 | 6/1998 | Wilcox et al. | 271/4.1 |

FOREIGN PATENT DOCUMENTS

| | | | |
|---|---|---|---|
| 404101939 | 4/1992 | Japan | 271/121 |

*Primary Examiner*—H. Grant Skaggs
*Attorney, Agent, or Firm*—Rosenberg, Klein & Lee

[57] ABSTRACT

A sheet-by-sheet paper feeding structure includes a sheets separating plate and a pressure plate. When a pile of paper is fed into the paper feeding structure, a front end of the pile urges against the sheets separating plate, which is in turn pressed by a press leg of the press plate above so that the sheets of paper are checked from displacing forwardly. The press plate further includes elastic plates having elastic plate press legs that help keep the sheets of paper flat and stable during feeding. A lowermost sheet of the pile is in direct contact with a roller of a facsimile machine or printer or the like. When the roller rolls forwardly, it will only bring the lowermost sheet to advance forwardly while the rest of the pile is being checked by the sheets separating plate.

1 Claim, 4 Drawing Sheets

SHEET-BY-SHEET PAPER FEEDING STRUCTURE

BACKGROUND OF THE INVENTION

1. Field of the Invention

The present invention relates to a sheet-by-sheet paper feeding structure which may effectively reduce the number of components of the structure and simplify the procedures of feeding to thereby lower manufacturing and assembly cost and time, enhance the reliability of paper feeding in facsimile machines, printers, etc., raise product quality, and increase market competitiveness.

2. Description of the Prior Art

FIG. 1 shows a conventional sheet-by-sheet paper feeding structure. As shown, a press plate 94 and a spring 95 are installed in a cavity below a rectangular projecting element 963 from below a housing plate 96. A guide post 941 of the press plate 94 is inserted into guide holes 962 respectively formed at both sides of the projecting element 963. A securing plate, a sheets separating plate 92, and a slide plate 93 are, by means of securing holes 912, sheets separating plate holes 921 and slide plate holes 931, respectively aligned with posts 961 and installed from above. The front sections of elastic plates 913, the sheets separating plate 92 and the slide plate 93 are passed into an elongated through hole 964 and out through the lower side of the housing plate 96 to be subjected to the downward pressure exerted by the press plate 94.

It can be seen that the conventional paper feeding structure comprises many components and is difficult to assemble, which lead to lowering of the reliability of paper feeding and high assembly cost. Improvements thereon are therefore necessary.

SUMMARY OF THE INVENTION

The present invention relates to a sheet-by-sheet paper feeding structure which may effectively reduce the number of components of the structure and simplify the procedures of feeding to thereby lower manufacturing and assembly cost and time, enhance the reliability of paper feeding in facsimile machines, printers, etc., raise product quality, and increase market competitiveness.

A primary object of the present invention is to provide a sheet-by-sheet paper feeding structure which reduces the number of components thereof, and which simplify assembly thereof to thereby lower manufacturing cost and enhance product quality.

According to the present invention, the sheet-by-sheet paper feeding structure comprises a sheets separating plate formed of a rubber material of a relatively high friction coefficient, a pressure plate including elastic plates at both sides thereof respectively and a press leg at one side, the elastic plates each having an elastic plate press leg at a front end thereof, and a slide plate having a surface formed of a plastic material having a relatively low friction coefficient. When a pile of paper is placed in the paper feeding structure, a front end thereof urges against the sheets separating plate, the front end of which is in turn pressed by press legs of the pressure plate, thereby checking the forward displacement of the pile of paper. The elastic plate press legs are provided to slightly press against the pile of paper to keep the paper flat and stable during the operation of feeding. The lowermost sheet of paper is in direct contact with a roller of a facsimile machine, printer, or the like. The surface of the roller is formed of a material of a high friction coefficient (such as rubber). When the roller rolls forwardly, only the lowermost sheet of paper will be brought to move forwardly while the rest of the pile remains being checked by the sheets separating plate.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
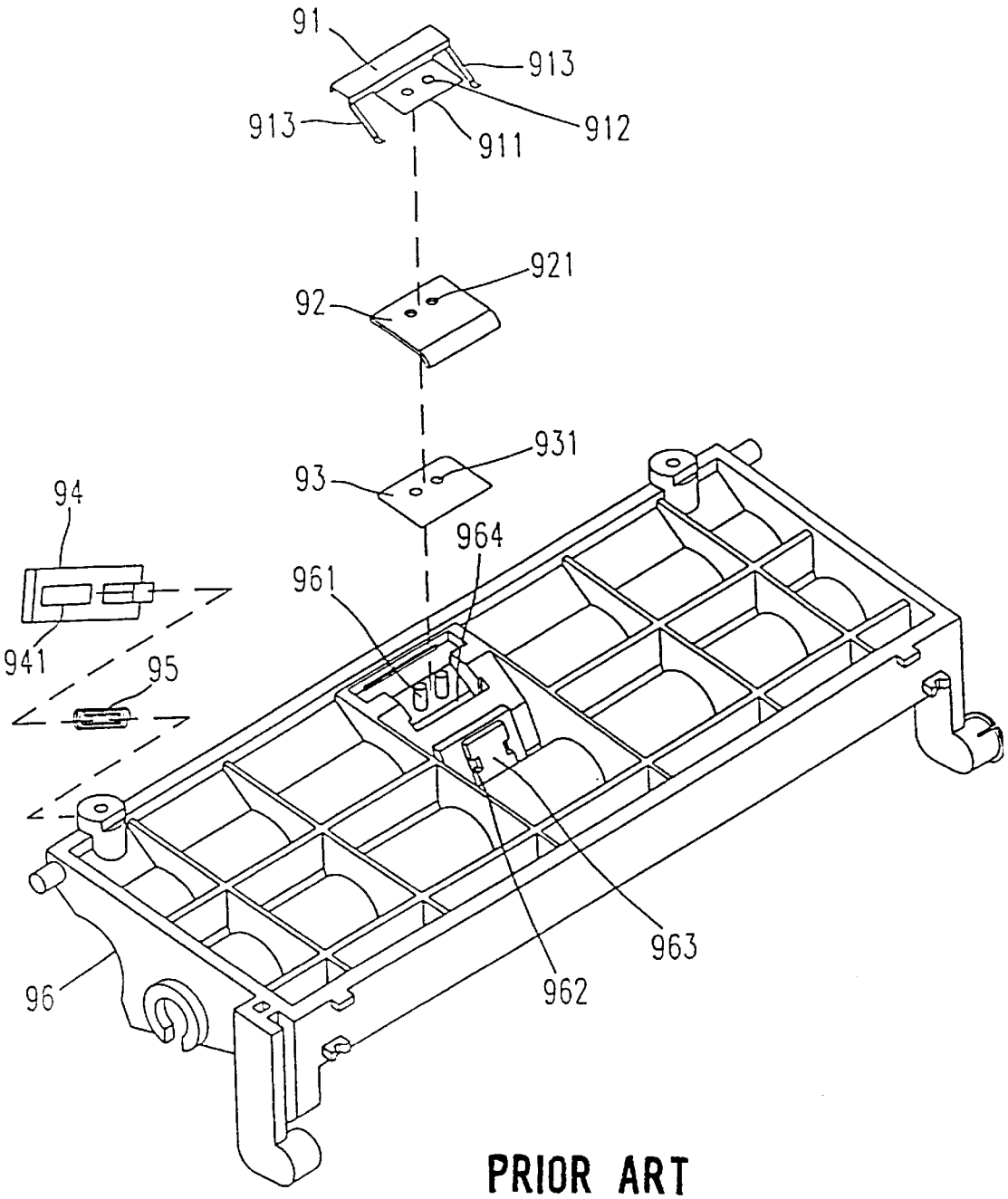
PRIOR ART FIG. 1
FIG. 1 is a schematic view of the structure of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figures 2, 2A, 2B:
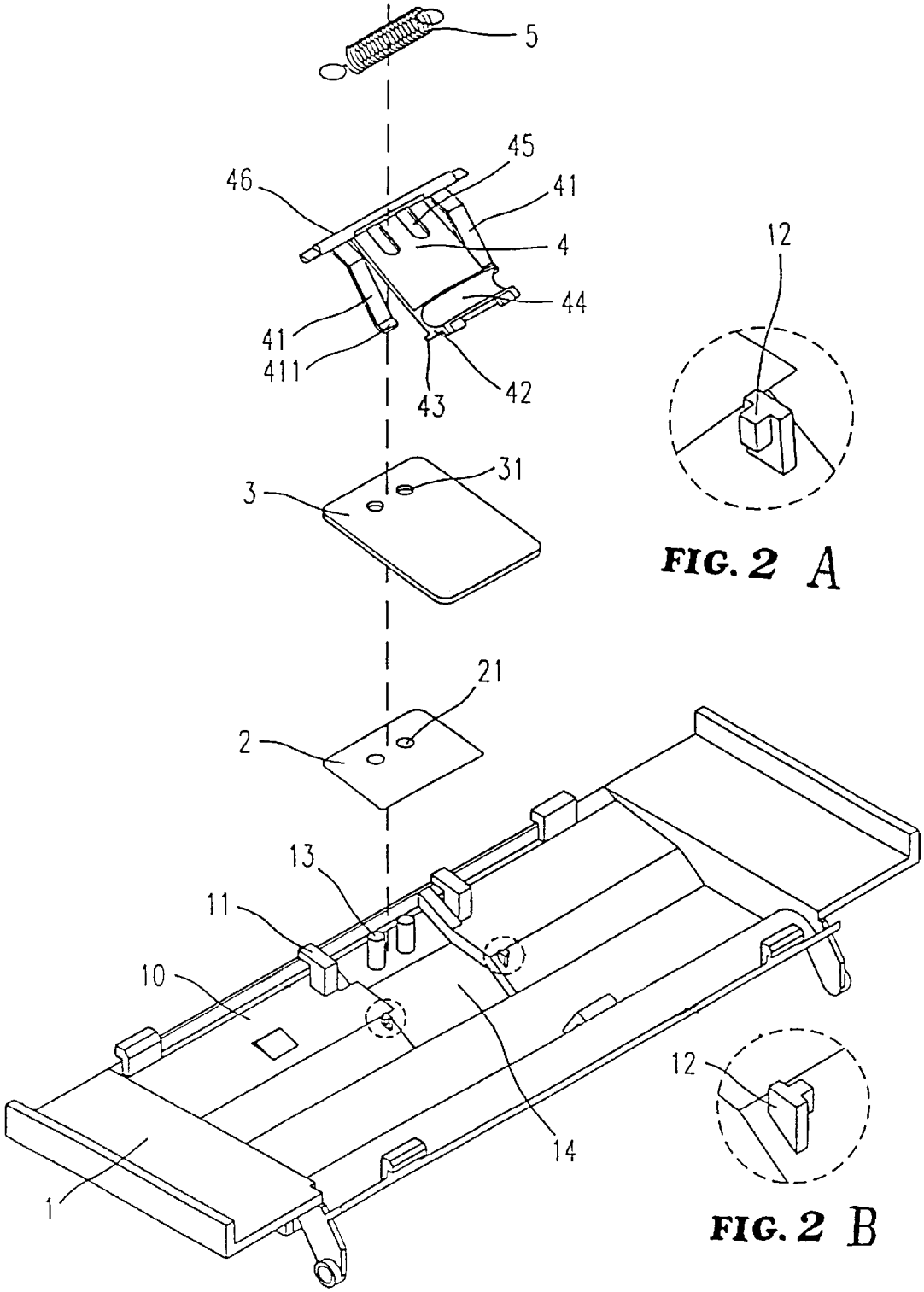
FIG. 2 is a schematic exploded view of the present invention.
FIGS. 2A and 2B are respectively enlarged views of retention hooks according to the present invention.

With reference to FIGS. 2, 2A and 2B, a preferred embodiment of the present invention essentially comprises a sheets separating structure 1, a slide plate 2, a sheets separating plate 3, a pressure plate 4, and a spring 5.

The sheets separating structure 1 includes a housing plate 10, two shaft mounts 11 at one side of the housing plate 10, two posts 13 and an opening 14 disposed between the shaft mounts 11, and two retention hooks 12 respectively provided at both sides of the opening 14.

The slide plate 2 has two slots 21 that are used to fit over the posts 13. The slide plate 2 is made of a plastic material and has a relatively low friction coefficient to assist feeding of sheets of paper 8 into a paper feeding structure.

The sheets separating plate 3 has two through holes 31 which are used to fit over the posts 13. The sheets separating plate 3 is made of a rubber material and has a relatively large friction coefficient to check the forward displacement of sheets of paper 8.

Figure 4:
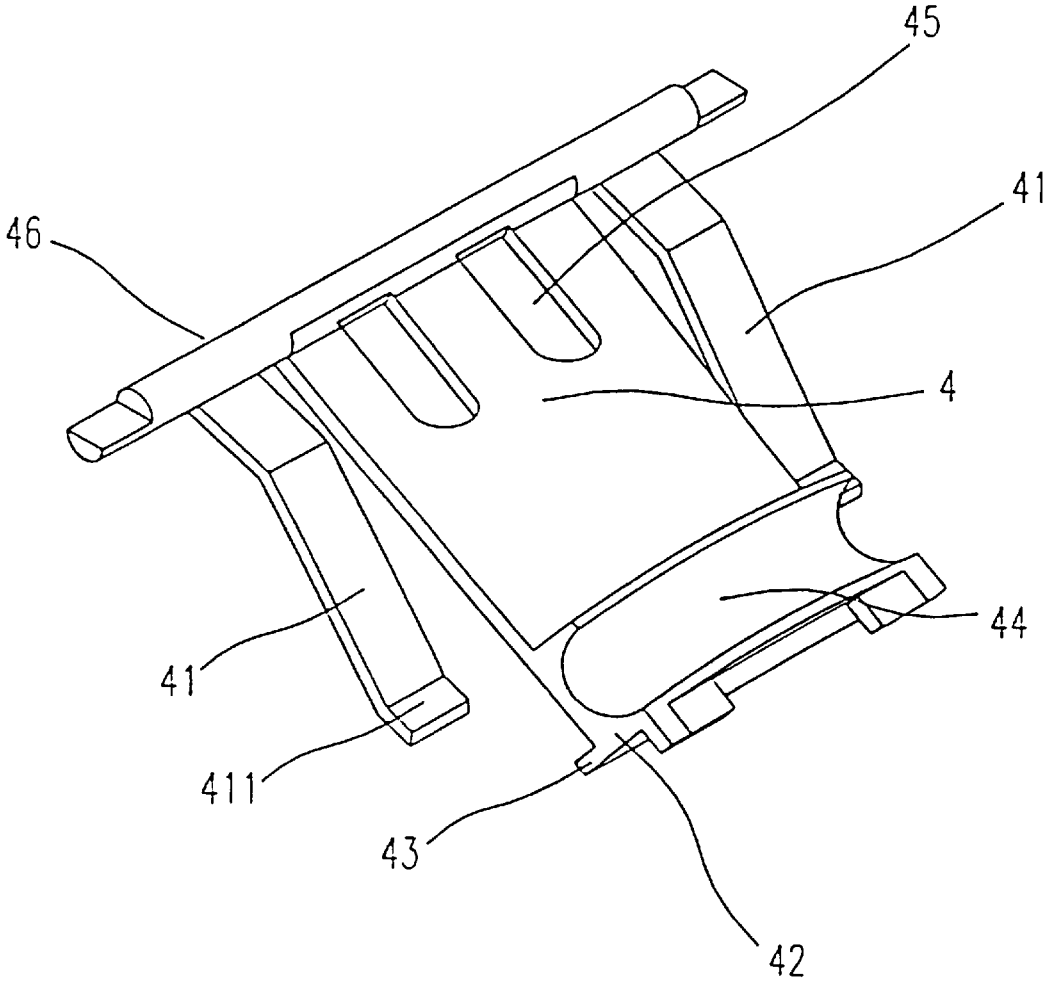
FIG. 4 is a schematic view of the structure of a pressure plate according to the present invention.

Referring to FIG. 4, which illustrates the structure of the pressure plate 4, the pressure plate 4 is shown to be provided with a shaft 46 at an upper side, a press block 42 at a lower side, two elastic plates 41 being respectively disposed at both lateral sides of the shaft 46. A front section of each elastic plate 41 is provided with an elastic press leg 411 that is adapted to press the sheets of paper 8. Two elongate holes 45 are formed in the pressure plate 4 between the elastic plates 41. The press block 42 has a transverse strip-like press leg 43 at a lower side thereof, and a semi-circular curved groove 44 provided at an upper side thereof for receiving the spring 5. The groove 44 is configured to be slightly curved along its axis in order to match the shape of the spring 5 when the latter is compressed.

Referring to FIG. 2, which illustrates assembly of the sheet-by-sheet paper feeding structure of the present invention, the slots 21 of the slide plate 2 are initially aligned with and then fitted over the posts 13. The through holes 31 of the sheets separating plate 3 are next aligned with the posts 13 and then fitted over the posts 13. The shaft 46 of the pressure plate 4 is snapped into the shaft mounts 11, and the elongated holes 45 of the pressure plate 4 are fitted over the posts 13 respectively, with the posts 13 projecting from the elongated holes 45. Finally, the spring 5 is disposed in the groove 44 of the pressure plate 44, and hooking rings of the spring 5 are respectively fastened to the retention hooks 12 to accomplish assembly of the present invention. At this point, the slide plate 2, the sheets separating plate 3, and the elastic plates 41 and press block 42 of the pressure plate 4 are respectively inserted into the opening 14 at the middle of the sheets separating structure 1 and out through the lower side of the sheets separating structure 1 to be subjected to the downward force exerted by the spring 5. The press leg 43 of the pressure plate 4, in particular, presses the front section of the sheets separating plate 3.

Figure 3:
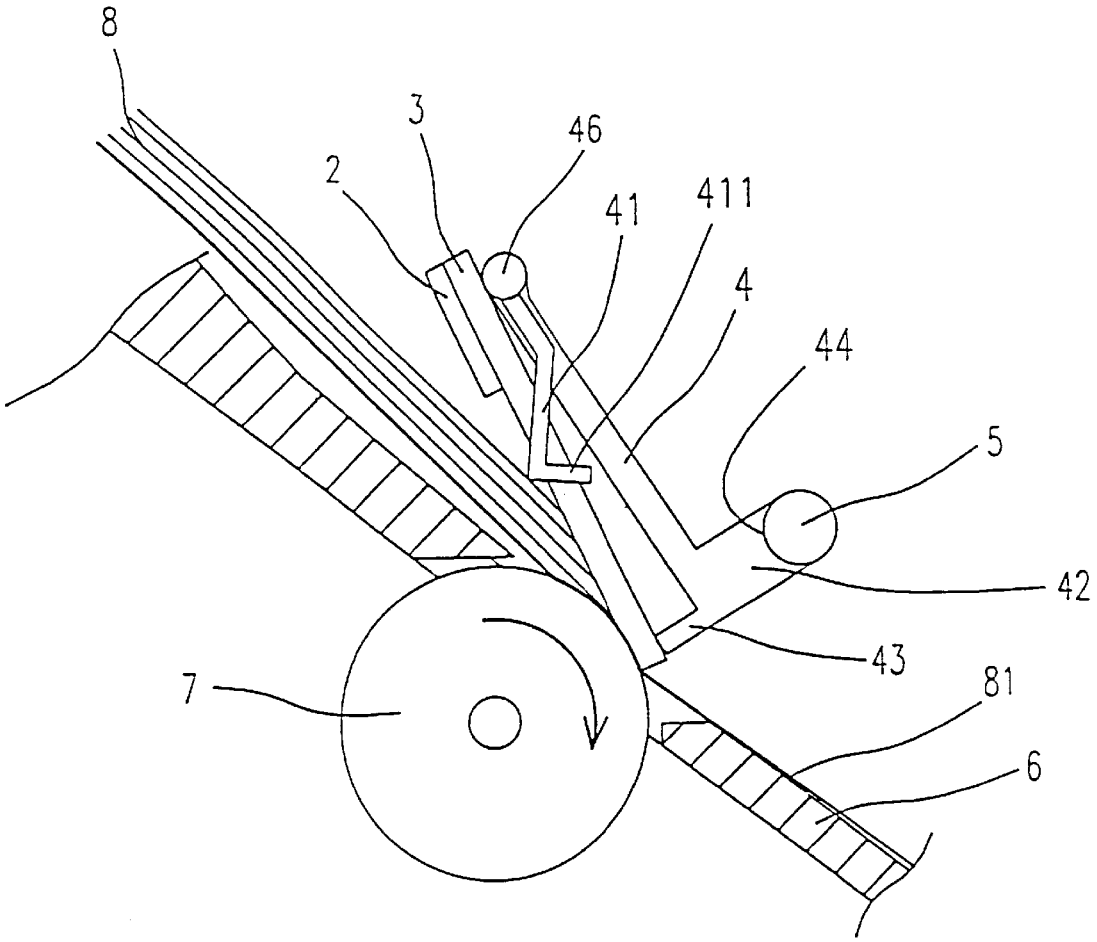
FIG. 3 is a schematic view side view illustrating operation of the present invention.

Referring to FIG. 3, it is shown that the sheet-by-sheet paper feeding structure of the present invention is assembled to a printer or a facsimile machine. There is shown a machine frame 6 internally provided with a roller 7. When a user places a pile of sheets of paper 8 into the sheet-by-sheet paper feeding structure, the front end of the pile urges against the sheets separating plate 3. Since the sheets separating plate 3 is made of rubber and therefore has a relatively high friction coefficient, and since the front end of the sheets separating plate 3 is being pressed by the press leg 43, the sheets of paper 8 are prevented from sliding forwardly. The elastic press legs 411 of the elastic plates 41 on the other hand slightly press against the sheets of paper 8 and hold the sheets of paper 8 to keep the sheets of paper 8 flat and stable during the operation of the paper feeding structure. As the slide plate 2 is a made of plastic, it has relatively low friction coefficient and may assist the placement of the sheets of paper 8 when the sheets of paper 8 are placed into the sheets feeding mechanism. The lowermost sheet of paper 81 is in direct contact with the roller 7. The surface of the roller 7 is formed of a material having comparatively high friction coefficient (such as rubber). When the roller 7 rolls forwardly, it will only bring the lowermost sheet of paper 81 to move forwardly, while the rest of the sheets of paper 8 will be blocked by the sheets separating plate 3 and prevented from advancing forwardly. In this way, the sheets of paper may be fed singly.

It can be appreciated from the above that the sheet-by-sheet paper feeding structure according to the present invention improves the complicated assembly of conventional mechanisms, simplify the manufacturing and assembly processes, and enhance the reliability of paper feeding in facsimile machines or printers as well as product quality. At the same time, the conventional press plate 94 and the securing plate 91 are combined to form a pressure plate 4 to reduce the number of components.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A sheet-by-sheet paper feeding structure, which causes an outermost sheet of paper of a pile of paper to be separated from the rest of the pile, said paper feeding structure comprising:

a housing plate including provided with two shaft mounts at one side, two posts and an opening disposed between said shaft mounts, and two retention hooks provided at both sides of said opening respectively;

a roller having an outer surface formed of a material of a relatively high friction coefficient;

a slide plate having two slots for fitting over said posts and being made of a plastic material of a relatively low friction coefficient so as to assist feeding of paper into said sheet-by-sheet paper feeding structure;

a sheets separating plate having two through holes for fitting over said posts and being made of a rubber material of a relatively low friction coefficient so as to check forward displacement of paper;

a pressure plate having a shaft provided at an upper side thereof, two elastic plates disposed at both lateral sides thereof respectively and each having an elastic plate press leg at a front end thereof adapted to press the paper, two elongated holes formed between said elastic plates, and a press block at a lower side thereof opposite to said shaft, said press block having a transverse strip-like press leg at a lower side thereof adapted to urge against said sheets separating plate, and a semi-circular curved groove at an upper side thereof, said groove being substantially curved in an axial direction; and a spring disposed in said groove of said press block, said groove being curved in an axial direction to match the shape of said spring during application of pressure, said spring including two hooking rings respectively fastened to said retention hooks of said housing plate to provide said pressure plate with a downward pressing elastic force;

whereby when a user puts a pile of paper into said sheet-by-sheet paper feeding structure with the front end of the pile urging against said sheets separating plate, a front end of said sheets separating plate is pressed by said press leg of said press block so that it is capable of checking the forward displacement of the paper, while said elastic plate press legs of said elastic plates exert a slight pressure on the paper to keep the paper flat and stable during the operation of said sheet-by-sheet paper feeding structure, with a lowermost sheet of paper in direct contact with the roller so that, when the roller rolls forwardly, it will only bring the lowermost sheet of paper to advance forwardly-while the rest of the pile remains checked by said sheets separating plate from displacing forwardly.

* * * * *